US007323664B1

(12) United States Patent
Takai et al.

(10) Patent No.: US 7,323,664 B1
(45) Date of Patent: Jan. 29, 2008

(54) HEATING SYSTEM

(75) Inventors: Toshihiro Takai, Aichi-gun (JP); Yasuyoshi Ohashi, Aichi-gun (JP); Kazushi Hayashi, Aichi-gun (JP)

(73) Assignee: Asano Laboratories Co., Ltd., Aichi-ken (JP)

( * ) Notice: Subject to any disclaimer, the term of this patent is extended or adjusted under 35 U.S.C. 154(b) by 0 days.

(21) Appl. No.: 11/558,516

(22) Filed: Nov. 10, 2006

(30) Foreign Application Priority Data

Aug. 29, 2006 (JP) ..... P2006-232256

(51) Int. Cl.
*H05B 1/02* (2006.01)

(52) U.S. Cl. ..... 219/488; 219/505; 219/539; 219/548; 219/552; 338/22 R

(58) Field of Classification Search ..... 219/504, 219/505, 481, 488, 497, 501, 521, 539, 541, 219/548, 552; 338/22 R
See application file for complete search history.

(56) References Cited

U.S. PATENT DOCUMENTS 4,766,365 A * 8/1988 Bolduc et al. ..... 323/308
5,574,418 A * 11/1996 Matsumura ..... 336/5
2007/0096278 A1* 5/2007 Nakatsu et al. ..... 257/678

FOREIGN PATENT DOCUMENTS

JP 2002-260831 9/2002

* cited by examiner

*Primary Examiner*—Mark Paschall
(74) *Attorney, Agent, or Firm*—Wood, Herron & Evans LLP

(57) ABSTRACT

A heating system includes a plurality of radiant heaters, a power source supplying electricity to the radiant heaters, and a transformer provided between the radiant heaters and the power source, wherein each of the radiant heaters includes a support plate substantially having a rectangular shape, a pair of connection terminals substantially perpendicularly extending, while having a space therebetween, from one surface of the support plate, and a strip-shaped heater element arranged between the pair of connection terminals and covering the one surface of the support plate, wherein voltage E between the pair of connection terminals is adjusted by the transformer so as to satisfy an inequality of 25 V≦E≦35 V, wherein a width W of the strip-shaped heater element is set so as to satisfy an inequality of 8.5 mm≦W≦11.7 mm, and a thickness t thereof is set so as to satisfy an inequality of 0.05 mm≦t≦0.8 mm, and wherein the radiant heaters are connected to the transformer in a 3-phase and 4-wire configuration, a neutral line is connected to ones of the connection terminals, and one of a U-phase, V-phase, and W-phase of a secondary side of the transformer is connected to the others of the connection terminals.

2 Claims, 7 Drawing Sheets

HEATING SYSTEM

BACKGROUND OF THE INVENTION

1. Field of the Invention

The present invention relates to a heating system in which radiant heaters for heating a heated object using radiant heat thereof are arranged in plurality.

Priority is claimed on Japanese Patent Application No. 2006-232256, filed Aug. 29, 2006, the content of which is incorporated herein by reference.

2. Description of Related Art

Conventionally, as the type of radiant heater described above, a radiant heater has been proposed, as disclosed, for example, in Japanese Unexamined Patent Application, First Publication No. 2002-260831, in which a strip-shaped heater element is arranged on one surface of a support plate in which a pair of connection terminals are arranged while having a space therebetween in such a manner that the width direction of the strip-shaped heater element is in parallel with the support plate, and the strip-shaped heater element substantially covers an entirety of the one surface of the support plate.

In this radiant heater, the strip-shaped heater element is directly heated by supplying electrical power to the strip-shaped heater element via the connection terminals, and a heated object is heated using radiant heat from the strip-shaped heater element.

In such a radiant heater, normally, a single phase 2-wire is employed for wiring using 3-phase AC power, and relatively high voltage is applied to the strip-shaped heater element so that an efficient heating is achieved.

Moreover, the temperature of the strip-shaped heater element can be adjusted by changing electrical current or voltage being supplied to the strip-shaped heater element, and the state of heating of the heated object due to the radiant heater can be controlled in a preferable responsive manner.

Incidentally, in the conventional radiant heater, because relatively high voltage (e.g., 200 V) of the 3-phase AC power is applied to the strip-shaped heater element, peripheral devices or the like may be seriously affected in case of electricity leakage.

Furthermore, if the radiant heater is arranged in plurality, it is necessary to power supply cables must be connected to each of the radiant heaters, and the connecting work for wirings is difficult due to interference between the power supply cables.

SUMMARY OF THE INVENTION

The present invention was made in view of the aforementioned circumstances, and an object thereof is to provide a heating system in which an amount of heat of a radiant heater is ensured, and an easy wiring work is achieved.

In order to achieve the above object, the present invention provides a A heating system including: a plurality of radiant heaters; a power source supplying electricity to the radiant heaters; and a transformer provided between the radiant heaters and the power source, wherein each of the radiant heaters includes: a support plate substantially having a rectangular shape; a pair of connection terminals substantially perpendicularly extending, while having a space therebetween, from one surface of the support plate; and a strip-shaped heater element arranged between the pair of connection terminals and covering the one surface of the support plate, wherein voltage E between the pair of connection terminals is adjusted by the transformer in a range satisfying an inequality of $25\ V \leqq E \leqq 35\ V$, wherein a width W of the strip-shaped heater element is set in a range satisfying an inequality of $8.5\ mm \leqq W \leqq 11.7\ mm$, and a thickness t thereof is set in a range satisfying an inequality of $0.05\ mm \leqq t \leqq 0.8\ mm$, and wherein the radiant heaters are connected to the transformer in a 3-phase and 4-wire configuration, a neutral line is connected to ones of the connection terminals, and one of a U-phase, V-phase, and W-phase of a secondary side of the transformer is connected to the others of the connection terminals.

According to the heating system of the present invention, because the voltage E between the pair of connection terminals is adjusted by the transformer in a range satisfying an inequality of $25\ V \leqq E \leqq 35\ V$, adverse effects on the peripheral devices or the like in case of electricity leakage can be minimized.

Furthermore, because the width W of the strip-shaped heater element is set in a range satisfying an inequality of $8.5\ mm \leqq W \leqq 11.7\ mm$, and the thickness t thereof is set in a range satisfying an inequality of $0.05\ mm \leqq t \leqq 0.8\ mm$, the cross-section area of the strip-shaped heater element is small and electric resistance thereof is large, and heating performance can be ensured even the voltage E between the pair of connection terminals is set in a range satisfying an inequality of $25\ V \leqq E \leqq 35\ V$. In addition, the rigidity of the strip-shaped heater element is ensured, and thermal deformation during heating can be prevented.

Moreover, because the width W is ensured, it is easy to dispose the strip-shaped heater element so as to cover the one surface of the support plate, and the heated object can be evenly heated.

Moreover, because the radiant heaters are connected to the transformer in a 3-phase and 4-wire configuration, a neutral line is connected to ones of the connection terminals, and one of a U-phase, V-phase, and W-phase of a secondary side of the transformer is connected to the others of the connection terminals, the radiant heaters are respectively connected by U-N, V-N, and W-N, and only electrical current corresponding to imbalance components of the heaters flow through the neutral line; therefore, the neutral line can be made thin and the wiring work can be easily carried out.

In the above heating system, the ones of the connection terminals may be arranged in a row and may be connected to each other by a bus bar.

In this case, because it is not necessary to individually connect the neutral line to the radiant heaters, the wiring work can be further facilitated.

As described above, according to the present invention, a heating system can be provided in which an amount of heat of a radiant heater is ensured, and an easy wiring work is achieved.

DETAILED DESCRIPTION OF THE INVENTION

Figure 1:
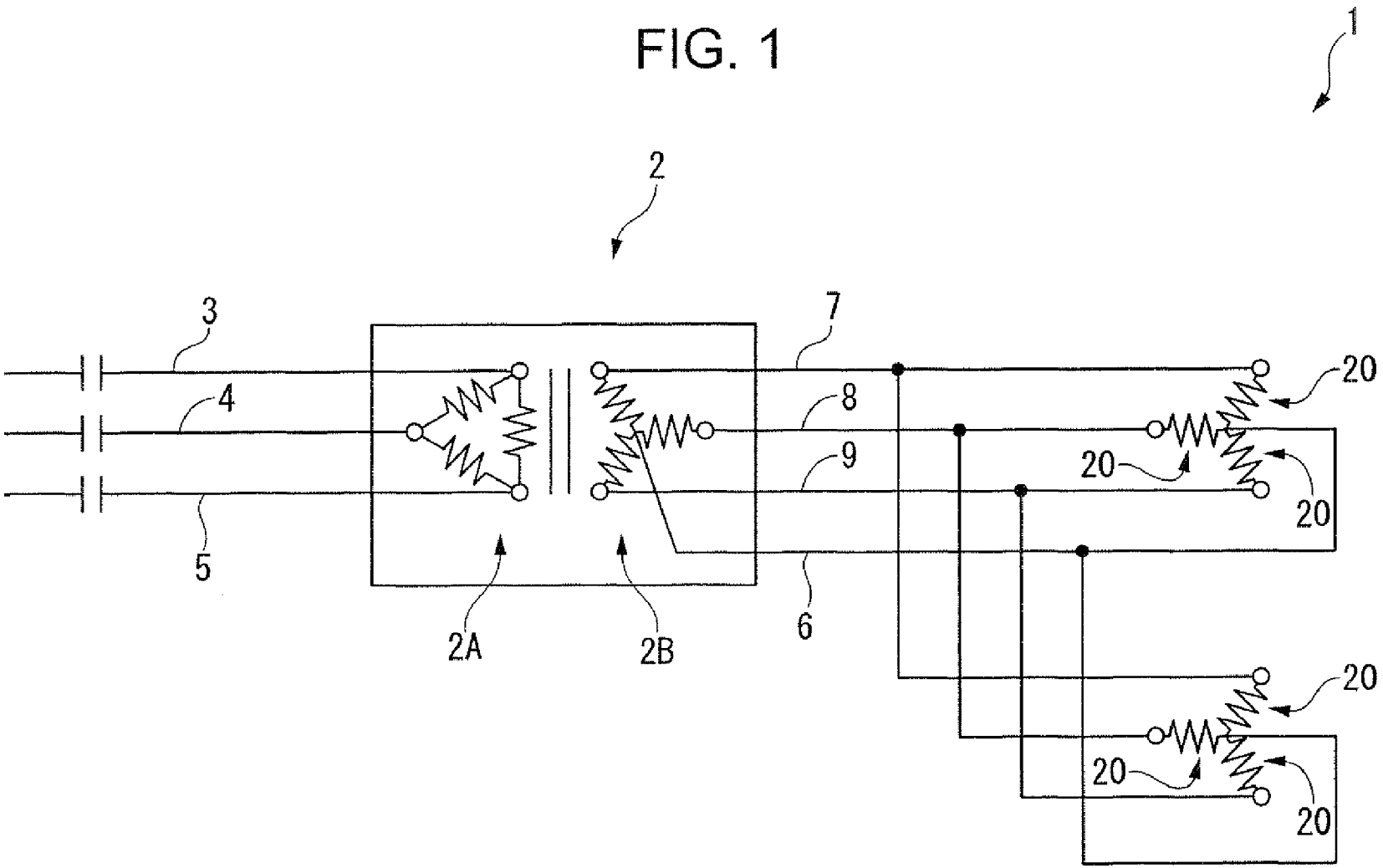
FIG. 1 is a diagram showing a power source system of a heating system as an embodiment.
Figure 2:
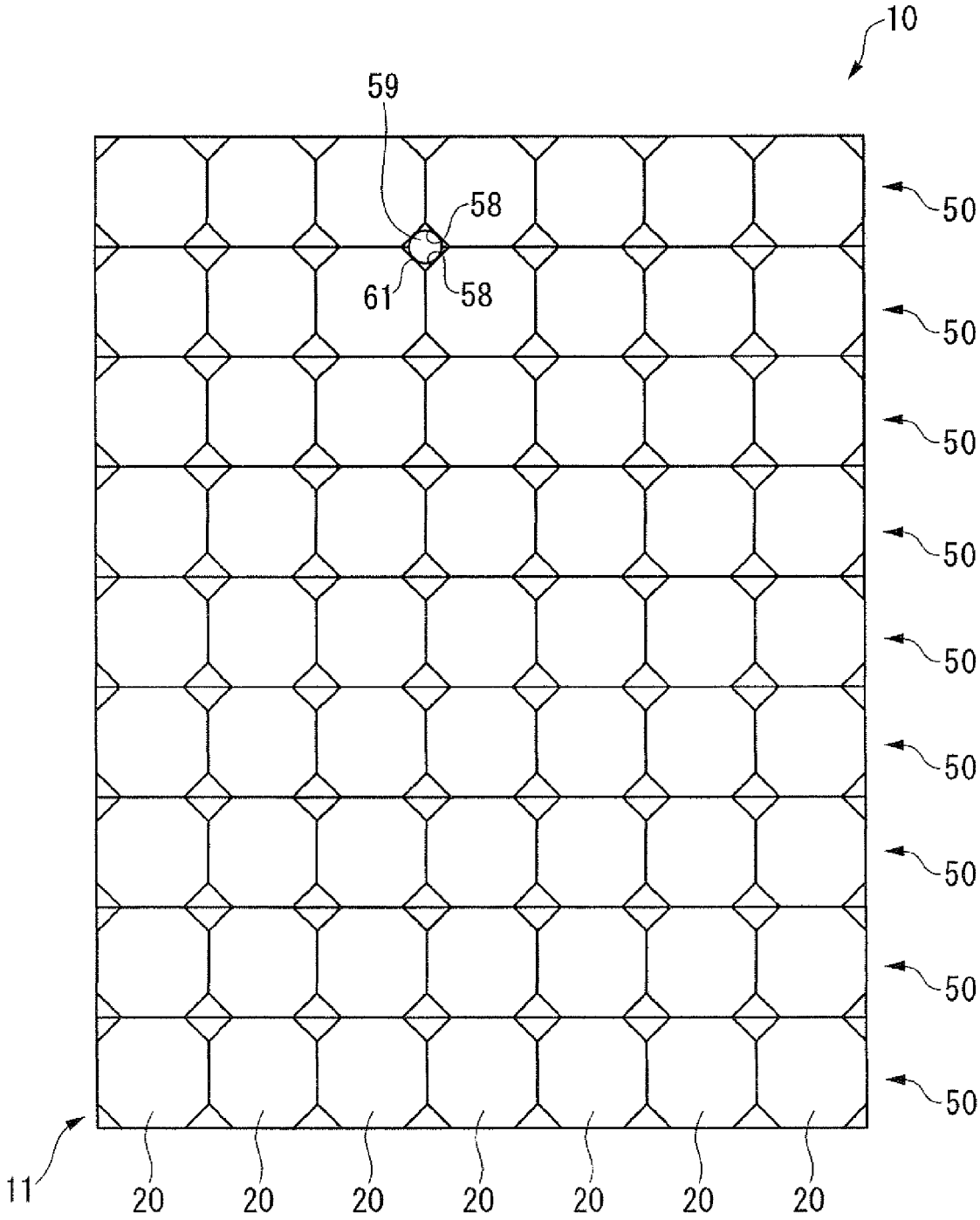
FIG. 2 is a front view of a heating unit constituting the heating system shown in FIG. 1.
Figure 3:
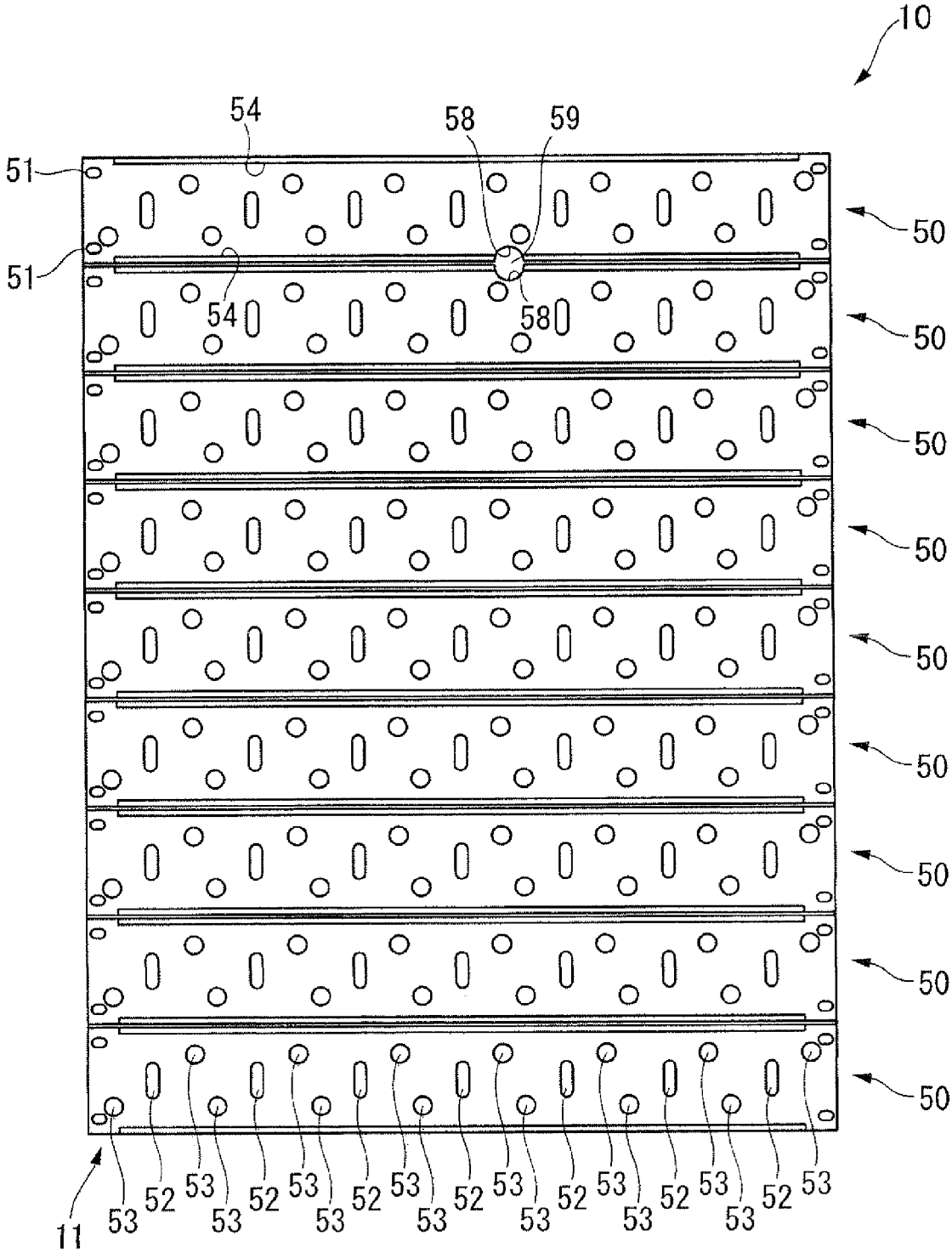
FIG. 3 is a back view of the heating unit shown in FIG. 2.
Figure 6:
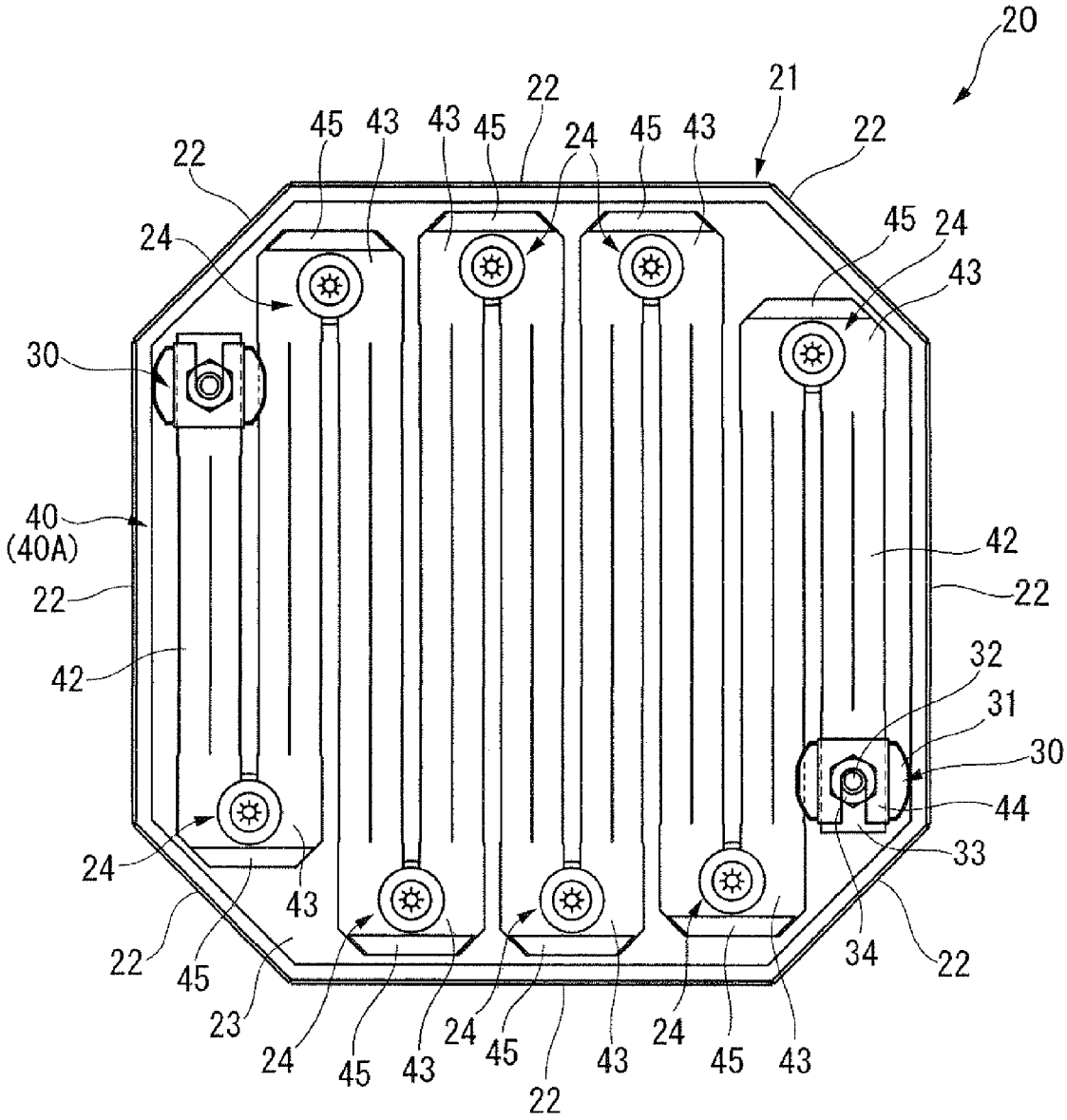
FIG. 6 is a front view of a radiant heater that is mounted on the heating unit shown in FIG. 2.
Figure 7:
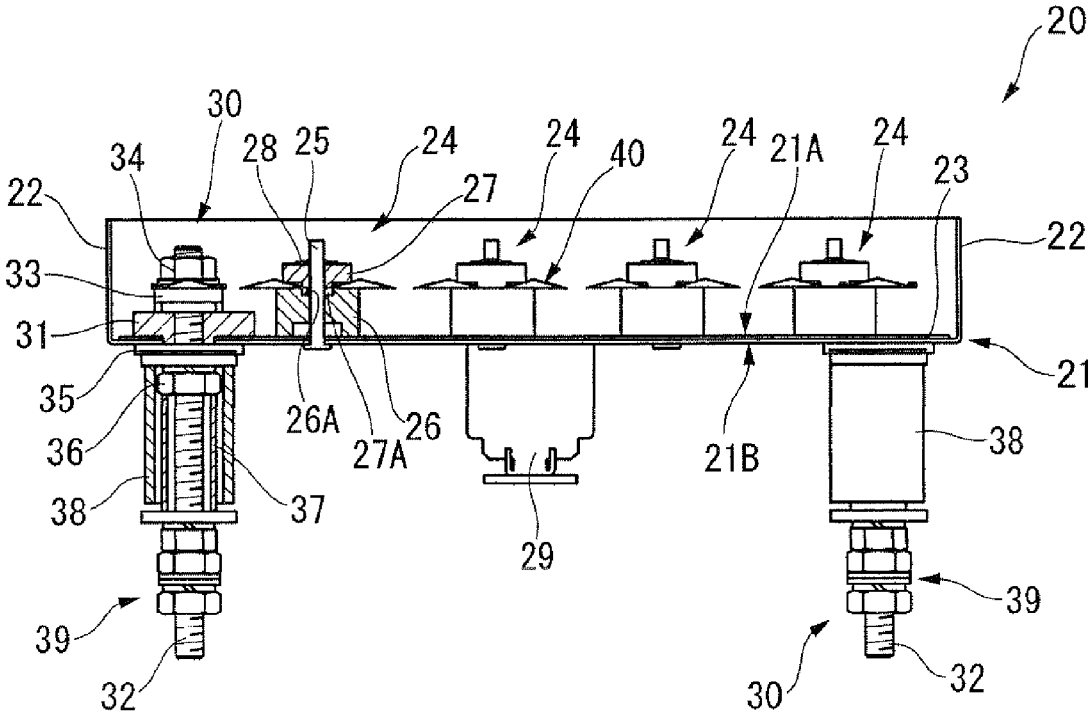
FIG. 7 is a cross-sectional view of the radiant heater shown in FIG. 6.
Figure 8:
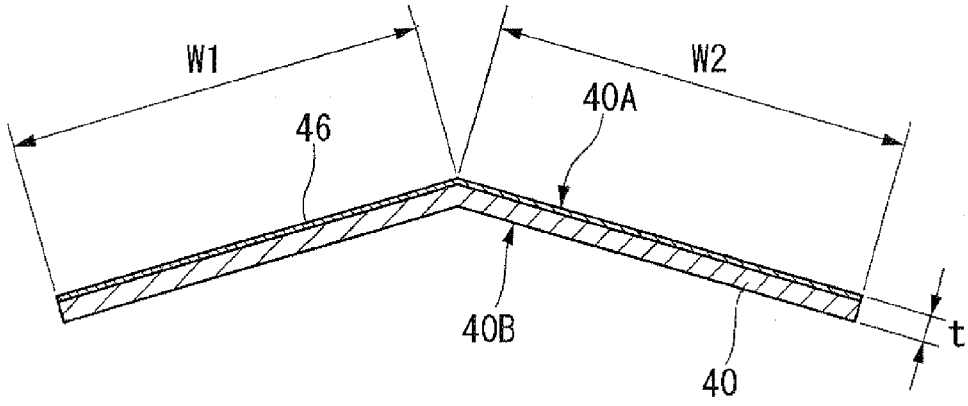
FIG. 8 is a partially enlarged cross-sectional view of a strip-shaped heater element included in the radiant heater shown in FIG. 6.

An embodiment of the present invention will be explained below with reference to the drawings. A power source system diagram of a heating system as an embodiment is shown in FIG. 1. FIGS. 2 to 5 show a heating unit that constitute the heating system. Moreover, FIGS. 6 to 8 show a radiant heater employed in the heating unit.

The heating system 1 includes a heating unit 10 in which radiant heaters 20 each substantially having a square plate shape are mounted on a frame 11, and a transformer 2 provided between the radiant heaters 20 and a power source.

In this embodiment, a 3-phase AC power source of 200 V is employed as the power source, an R-phase, 3, an S-phase 4, and a T-phase 5 of the 3-phase AC power source are respectively connected to the primary side 2A of the transformer 2, and the plurality of the radiant heaters 20 are connected to the secondary side 2B of the transformer 2 in a 3-phase and 4-wire configuration. In other words, a neutral line 6 (N) and one of a U-phase 7, a V-phase 8, and a W-phase 9 is connected to the radiant heater 20.

Moreover, the voltage E between the U-phase 7 and the neutral line 6, between the V-phase 8 and the neutral line 6, and between the W-phase 9 and the neutral line 6 is set in a range satisfying an inequality of 25 V≦E≦35 V, and more specifically set to 32 V.

Next, the heating unit 10 will be explained. The heating unit 10 includes brackets 50 on which the radiant heaters 20 are mounted in a row, and the frame 11 on which the brackets 50 are mounted in a parallel arrangement.

As shown in FIGS. 6 and 7, the radiant heater 20 includes a support plate 21 having a substantially square plate shape, and more specifically, having an octagonal plate shape that is conceptually made by cutting off four corners of a square plate along lines each of which intersects the sides of the square plate at 45°, and a strip-shaped heater element 40 disposed above a surface 21A (shown as an upper surface in FIG. 6) of the support plate 21 that is oriented in one direction.

The support plate 21 is made of, for example, a stainless steel plate, and at each side of the octagonal plate, a side wall portion 22 is provided which is made by bending in the direction in which the surface 21A is oriented so as to be perpendicular to the support plate 21, and thus the support plate 21, as a whole, has an octagonal tray shape. A slit is defined between the pair of side wall portions 22 that are provided at the sides of the octagonal plate.

A mica sheet 23 having superior heat insulation property and electrical insulation property is adhered to the surface 21A of the support plate 21 that is oriented in the one direction.

Furthermore, bridging support members 24 and a pair of connection terminals 30 are provided on the surface 21A of the support plate 21 that is oriented in the one direction. In this embodiment, as shown in FIG. 6, the pair of connection terminals 30 is disposed on the diagonal of the octagonal plate (at upper-left and lower-right in FIG. 6), and eight bridging support members 24 are alternately disposed between the pair of connection terminals 30 and along a pair of opposed sides (the sides located at the upper and lower portions in FIG. 6) of the octagonal plate. The height of the bridging support members 24 and the pair of connection terminals 30 from the surface 21A of the support plate 21 that is oriented in the one direction is set lower by one step than that of the side wall portions 22.

As shown in FIG. 7, the bridging support member 24 includes a stud pin 25 that is fixed such that the stud pin 25 penetrates through a through hole formed in the support plate 21 and projects from the surface 21A oriented in the one direction, a pair of spacers (a first spacer 26 and a second spacer 27) having a substantially cylindrical shape through which the stud pin 25 penetrates, and a bush nut 28 for fixing the first and second spacers 26 and 27.

The first spacer 26 that is disposed on the surface 21A of the support plate 21 that is oriented in the one direction via the mica sheet 23 is made of an electrical insulator, and a recess 26A is formed at the center of one surface of the first spacer 26.

The second spacer 27 is also made of an electrical insulator, and has a projected portion 27A that projects toward the other side (downward in FIG. 7) and that is engageable with the recess 26A. The projected height of the projected portion 27A is made greater than the depth of the recess 26A, and thus a small space is formed around a portion of the stud pin 25 located between the first and second spacers 26 and 27.

Each connection terminal 30 includes an insulation piece 31 that has a rectangular plate shape and is pressed into a through hole formed at a corner portion of the support plate from the surface 21A oriented in the one direction, and a bolt 32 that penetrates through the support plate 21 and the insulation piece 31 and projects from the surface 21A of the support plate 21 that is oriented in the one direction and from the surface 21B of the support plate 21 that is oriented in the other direction.

An electrode metal member 33 and a fixing nut 34 are provided at a portion of the bolt 32 that projects from the surface 21A of the support plate 21 that is oriented in the one direction. Moreover, at a portion of the bolt 32 that projects from the surface 21B of the support plate 21 that is oriented in the other direction, an insulation washer 35 is fixed by a nut 36 via a washer while contacting the surface 21B of the support plate 21, an internal tube 37 and an insulation tube 38 are disposed at the other side of the washer, and a connection portion 39 to which a power supply cable 57 is to be connected is constituted by nuts and washers at a position away from the internal tube 37 and insulation tube 38.

In addition, the projected heights of the connection portions 39 provided on the pair of connecting terminals 30 from the surface 21B of the support plate 21 are set to be the same.

The strip-shaped heater element 40 is formed by cutting off a nichrome plate having a thin plate shape from the right and left alternately so as to form elongated nicks therein so that the strip-shaped heater element 40 configured to have a zigzag shape in which strip-shaped portions 42 and turning portions 43 are alternately disposed.

Each end of the strip-shaped heater element 40 is cut off in U-shape, and a reinforcing member 44 having a similar U-shape is stacked and connected to the end.

Moreover, a recess (not shown) with which the projected portion 27A of the second spacer 27 constituting the bridging support member 24 is engageable is formed at an inside portion of the turning portion 43. Furthermore, a conductive member 45 having a small thin plate configuration is stacked and adhered to an outside portion of the turning portion 43.

Moreover, as shown in FIG. 8, the cross section of the strip-shaped heater element 40 is bent in a V-shape in such a manner that the center of the width thereof is projected in the one direction (shown as upward direction in FIG. 8). In addition, the width W of the strip-shaped heater element 40 is set in a range satisfying an inequality of 8.5 mm≦W≦11.7 mm, and more specifically set to 10 mm. It should be noted that the strip-shaped heater element 40 is formed in a V-shape, and when defining the lengths of the oblique sides of the V-shaped cross-section to be W1 and 2W, the width W equals to W1+W2.

Furthermore, the thickness t of the strip-shaped heater element 40 is set in a range satisfying an inequality of 0.05 mm≦t≦0.8 mm, and more specifically set to 0.06 mm.

A surface of the strip-shaped heater element 40 that is oriented in the one direction is used as a heating surface 40A that is disposed so as to face a heated object, on which a coated film 46 is formed to increase a radiation factor by painting a synthetic resin paint having a heat resistance and exhibiting black color. Moreover, a surface of the strip-shaped heater element 40 that is oriented in the other direction, in which the paint is not applied and the coated film 46 is not formed, is used as an opposing surface 40B that is disposed so as to face the surface 21A of the support plate 21.

Here, the radiation factor of the heating surface 40A on which the coated film 46 is formed is set to be 0.96, and the radiation factor of the opposing surface 40B on which the coated film 46 is not formed is set in a range of 0.64 to 0.76.

The strip-shaped heater element 40 is mounted in such a manner that the opposing surface 40B faces the surface 21A of the support plate 21 that is oriented in the one direction, the ends of the strip-shaped heater element 40 are placed on the electrode metal member 33 provided on the connection terminal 30 and fixed by the fixing nut 34, and the recesses formed at the inside portions of the turning portions 43 of the strip-shaped heater element 40 are engaged with the projected portion 27A of the second spacer 27 of the bridging support member 24 so that the strip-shaped heater element 40 is movably supported in the space between the first spacer 26 and the second spacer 27 while being separated from the surface 21A of the support plate 21.

The fixing nuts 34 are welded to the bolts 32 to prevent loosening, and the tips of the stud pins 25 are deformed to prevent coming-off of the bush nuts 28.

Here, as viewed from a position facing the surface 21A of the support plate 21 that is oriented in the one direction, i.e., from a position facing the heating surface 40A of the strip-shaped heater element 40, the area of the strip-shaped heater element 40 occupies 55% to 75% of the area of the support plate 21, and more specifically, occupies 65% of the area of the support plate 21.

Moreover, an attachment portion 29 that has a rectangular cross-section and projects from the center of the octagonal face in parallel with the connection terminals 30 is provided on the surface 21B of the support plate 21 that is oriented in the other direction.

Figure 4:
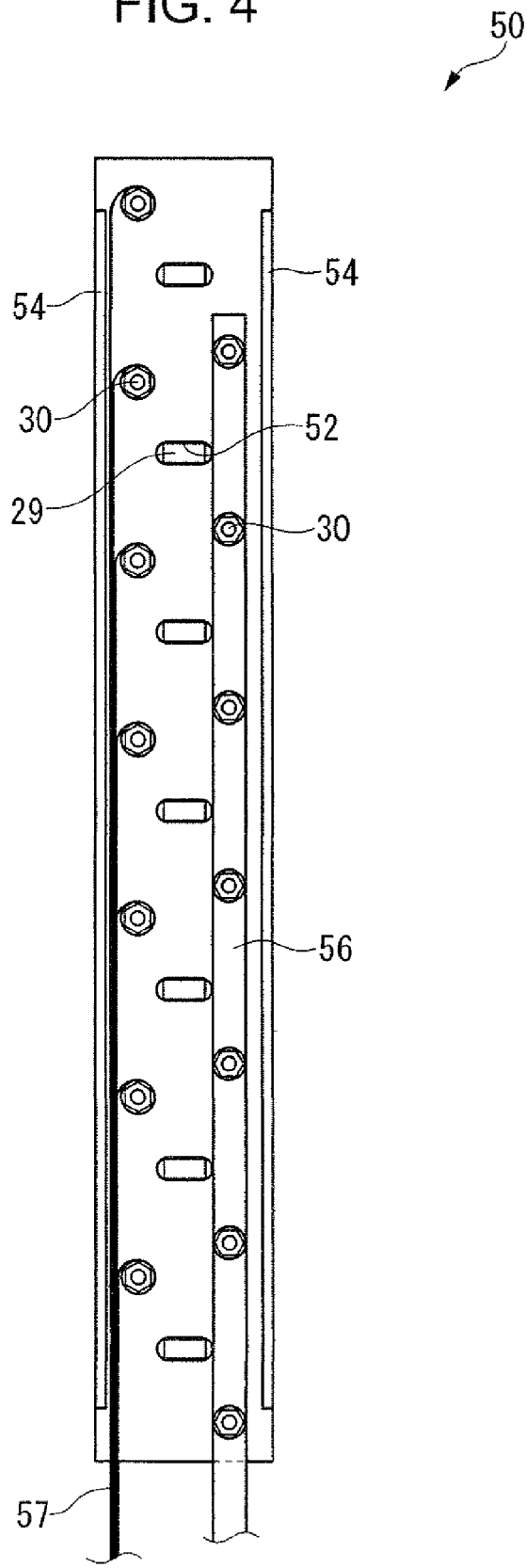
FIG. 4 is a diagram showing a bracket included in the heating unit shown in FIG. 2.

The bracket 50, on which the radiant heaters 20 configured as described above are arranged and mounted in a row, has a rectangular plate shape that extends in a direction along which the radiant heaters 20 arranged, as shown in FIG. 4. Fixing holes 51 into which fixing screws (not shown) for fixing the brackets 50 to the frame 11 are to be inserted are formed at both ends, in the longitudinal direction, of the bracket 50. The fixing holes 51 are oblong holes whose longer diameter extends in a direction along which the radiant heaters 20 are arranged in a row.

In addition, at the center in the width direction of the bracket 50, attachment holes 52 having an oval shape elongating in the width direction and into which the attachment portions 29 of the radiant heaters 20 are inserted are arranged in a row, and in particular in this embodiment, seven attachment holes 52 are provided. In other words, the bracket 50 is configured so as to allow seven radiant heaters 20 to be mounted thereon in a row.

At both sides of the attachment holes 52 in the width direction, terminal holes 53 into which the connection portions 39 of the pairs of connection terminals 30 are inserted are arranged in rows. In other words, the terminal holes 53, the attachment holes 52, and the terminal holes 53 are arranged in three rows.

Figure 5:
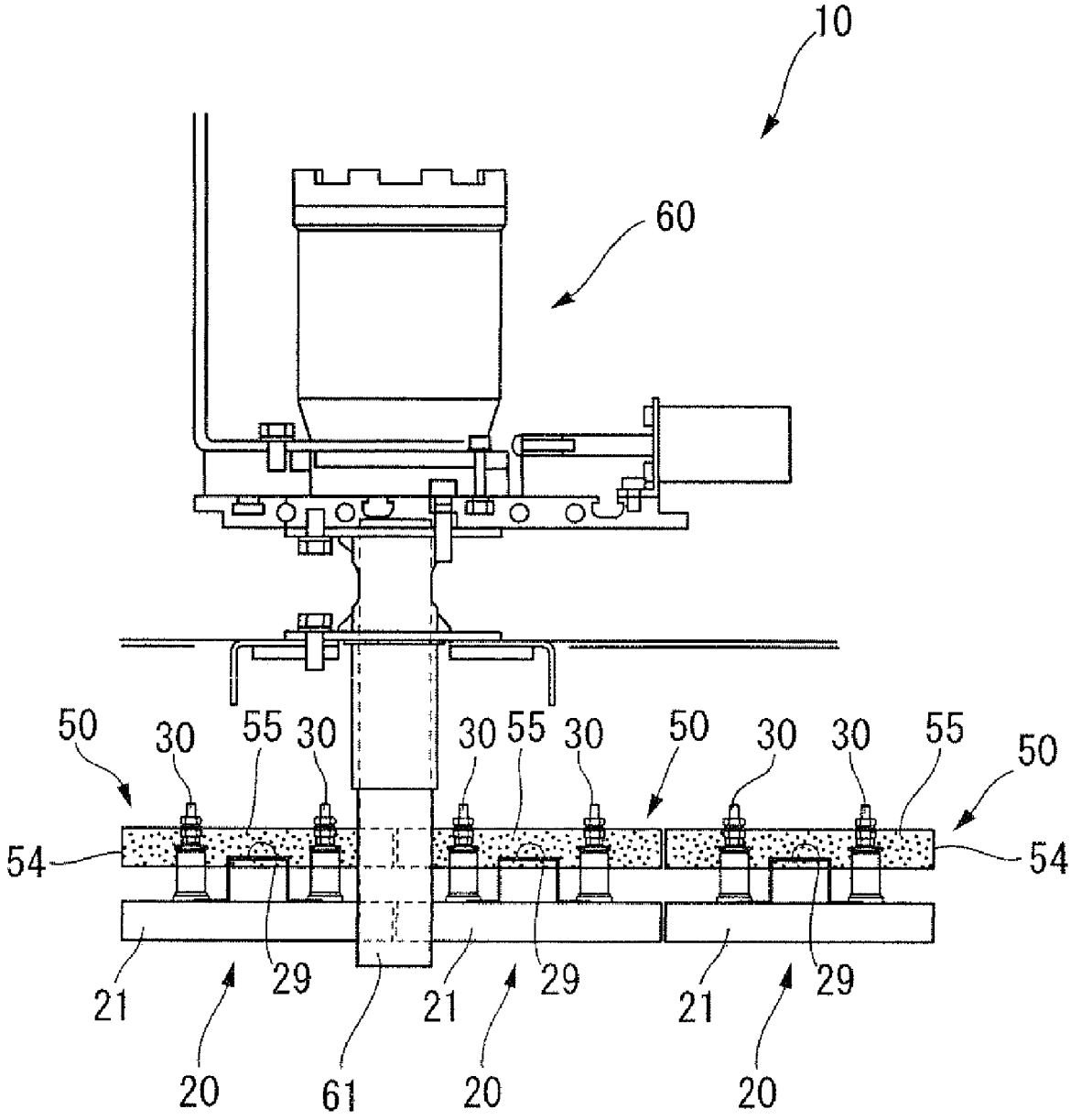
FIG. 5 is a partial cross-sectional view of the heating unit shown in FIG. 2.

Moreover, as shown in FIG. 5, each bracket 50 is bent in an L-shape at the both ends thereof in the width direction toward the attachment portions 29 of the radiant heaters 20 so as to form holding portions 54 for holding a heat insulator 55 such as made of ceramics fibers or the like.

The attachment portion 29 of the radiant heater 20 is inserted into the attachment holes 52, the connection portions 39 of the pair of connection terminals 30 are respectively disposed in the terminal holes 53, and the attachment portion 29 and the connection portions 39 are fixed by clamping members (not shown), thereby, as shown in FIG. 4, the radiant heater 20 is fixed in a state in which the support plate 21 is separated from the bracket 50.

It should be noted that the height of the attachment portion 29 is set so that the connection portions 39 of the connection terminals 30 that are inserted into the terminal holes 53 project from the heat insulator 55.

In FIG. 4, ones of the connection terminals 30 (the right ones in FIG. 4) of the seven radiant heaters 20 are connected to each other by a bus bar 56 made of copper, and further connected to the neutral line 6 (N) of the secondary side 2B of the transformer 2. Power supply cables 57 are respectively connected to others of the connection terminals 30 (the left ones in FIG. 4), and further connected to one of the U-phase 7, the V-phase 8, and the W-phase 9 of the secondary side 2B of the transformer 2.

The strip-shaped heater element 40 of each of the radiant heaters 20 that are arranged in plurality is heated by being supplied with electrical power, and the heating system 1 configured as described above heats a heated object using radiant heat from the strip-shaped heater element 40.

In the heating system 1 of the present invention, because the voltage E between the U-phase 7 and the neutral line 6, between the V-phase 8 and the neutral line 6, and between the W-phase 9 and the neutral line 6 is set in a range satisfying an inequality of 25 V≦E≦35 V, more specifically, set to 32 V, ones of the connection terminals 30 of the radiant heaters 20 are connected to the neutral line 6 (N), and the others of the connection terminals 30 are connected to one of the U-phase 7, the V-phase 8, and the W-phase 9, adverse effects on the peripheral devices in case of electricity leakage can be minimized due to low voltage while ensuring the heating operation of the strip-shaped heater element 40.

Moreover, because the width W of the strip-shaped heater element 40 is set in a range satisfying an inequality of 8.5 mm≦W≦11.7 mm, more specifically, set to 10 mm, and the thickness t of the strip-shaped heater element 40 is set in a range satisfying an inequality of 0.05 mm≦t≦0.8 mm, more specifically, set to 0.06 mm, the cross-section area of the strip-shaped heater element is small and electric resistance thereof is large, and heating performance of the strip-shaped heater element 40 can be ensured although a voltage of 32 V is relatively low.

Moreover, because the thickness t is set to 0.06 mm, and the rigidity of the strip-shaped heater element 40 is ensured, thermal deformation of the strip-shaped heater element 40 can be prevented.

Furthermore, because the width W is set to 10 mm, the strip-shaped heater element 40 can be easily arranged so as to cover the surface 21A of the support plate 21, and the heated object can be evenly heated.

Furthermore, in the heating system 1 of the present embodiment, because the radiant heaters 20 are connected in a 3-phase and 4-wire configuration, the neutral line 6 (N) is connected to ones of the connection terminals 30, and one of the U-phase, V-phase, and W-phase of the secondary side 2B of the transformer 2 is connected to the others of the connection terminals 30, only electrical current corresponding to imbalance components of the heaters flow through the neutral line 6; therefore, the neutral line 6 can be made thin and the wiring work can be further facilitated.

Moreover, because the ones of the connection terminals 30 of the radiant heaters 20 are arranged in a row and connected to each other by the bus bar 56, the neutral line 6 does not have to be individually connected to each of the radiant heaters 20, and the wiring work can be further facilitated.

Moreover, because the number of the power supply cables 57 is reduced, the power supply cables 57 do not interfere with each other even if the projected heights of the ones of the connection terminals 30 and the others thereof are set to be the same. Therefore, by setting the projected heights of the ones of the connection terminals 30 from the surface 21B of the support plate 21 and the others of the connection terminals 30 from the surface 21B of the support plate 21 to be the same, the overall thickness of the radiant heaters 20 can be reduced, and thus the size of the heating unit 10 can be minimized.

Moreover, because the radiant heaters 20 are mounted in plurality on the bracket 50 in a row, and the brackets 50 are mounted on the frame 11 in a parallel arrangement in the width direction, the heating unit 10 can be constituted by mounting the radiant heaters 20 on the respective brackets 50, and thereafter by mounting the brackets 50 on the frame 11, and thus it is easy to carry out the mounting work for the radiant heaters 20.

Furthermore, by adjusting the distance between the radiant heaters 20 in the row when the radiant heaters 20 are mounted on the bracket 50, and by adjusting the distance between the brackets 50 when the brackets 50 are mounted on the frame 11 in a parallel arrangement, interference between the radiant heaters 20 can be prevented when the radiant heaters 20 thermally deform.

Furthermore, in the radiant heater 20, because the coated film 46 that increases a radiation factor is formed on the heating surface 40A of the strip-shaped heater element 40 that faces the heated object (the resin sheet S), the heated object can be efficiently heated. Moreover, because the coated film 46 is not formed on the opposing surface 40B of the strip-shaped heater element 40 that faces the surface 21A of the support plate 21, radiation of heat from the opposing surface 40B is restrained, temperature rise in the support plate 21 is restrained, thermal effects to the support plate 21 and the connection terminals 30 can be restrained.

Furthermore, because radiant heat from the opposing surface 40B is restrained, it is not necessary to provide a reflection plate having a high reflectance on the support plate 21 to reflect heat, and the state of heating by the radiant heater 20 does not vary depending on the surface condition of the reflection plate. More specifically, in this radiant heater 20, the reflected heat hardly contributes to heating, and only radiant heat from the heating surface 40A of the strip-shaped heater element 40 contributes to heating of the heated object. Therefore, variation of the state of heating in the radiant heaters 20 is small even if the radiant heaters 10 are used while being arranged side by side, and thus the heated object can be evenly heated.

Moreover, because the area of the heating surface 40A of the strip-shaped heater element 40 occupies 55% to 75% of the area of the support plate 21, and more specifically, occupies 65% of the area of the support plate 21 when viewed from a position facing the heating surface 40A, the heated object can be evenly heated only by radiant heat from the strip-shaped heater element 40, space between the strip-shaped portions 42 that are disposed side by side can be ensured, and thus, even when the strip-shaped heater element 40 deforms due to thermal expansion thereof, mutant contact in the strip-shaped heater element 40 can be prevented, and the heated object can be efficiently heated by increasing the temperature of the strip-shaped heater element 40, i.e., by increasing the radiant heat.

Moreover, because the cross section of the strip-shaped heater element 40 is bent in a V-shape in such a manner that the center of the width thereof is projected in the one direction, the rigidity of the strip-shaped heater element 40 is ensured, and deformation of the strip-shaped heater element 40 during heating in such a manner that a portion thereof is sagged can be prevented.

Moreover, because the conductive member 45 is adhered to an outside portion of the turning portion 43 of the strip-shaped heater element 40, an electrical current path at the turning portion 43 is corrected, and an even current can be achieved.

While a heating system as an embodiment of the present invention has been described above, it should be understood that the present invention is not to be considered as limiting, and various modifications can be made without departing from the technical spirit of the invention.

For example, the description was made assuming that the power source is a 3-phase AC power source of 200 V; however, the configuration is not limited to this, and a 3-phase AC power source of 380 V, 100 V, or the like may be employed.

Moreover, the description was made assuming that the strip-shaped heater element is configured in a zigzag shape; however, the configuration is not limited to this, and the strip-shaped heater element may be configured in a spiral shape. It should be noted, however, that a zigzag-shaped configuration of the strip-shaped heater element as in the present embodiment is preferred because the connection terminals can be sufficiently separated from each other, which lead to an easy connecting operation.

Moreover, the description was made assuming that the area of the heating surface of the strip-shaped heater element occupies 55% to 75% of the area of the support plate, and more specifically, occupies 65% of the area of the support plate when viewed from a position facing the heating surface; however, the numerical range is not limited to this.

What is claimed is:

1. A heating system comprising:

a plurality of radiant heaters;

a power source supplying electricity to the radiant heaters; and a transformer provided between the radiant heaters and the power source, wherein each of the radiant heaters includes: a support plate substantially having a rectangular shape; a pair of connection terminals substantially perpendicularly extending, while having a space therebetween, from one surface of the support plate; and a strip-shaped heater element arranged between the pair of connection terminals and covering the one surface of the support plate, wherein voltage E between the pair of connection terminals is adjusted by the transformer in a range satisfying an inequality of 25 V≦E≦35 V, wherein a width W of the strip-shaped heater element is set in a range satisfying an inequality of 8.5 mm≦W≦11.7 mm, and a thickness t thereof is set in a range satisfying an inequality of 0.05 mm≦t≦0.8 mm, and wherein the radiant heaters are connected to the transformer in a 3-phase and 4-wire configuration, a neutral line is connected to ones of the connection terminals, and one of a U-phase, V-phase, and W-phase of a secondary side of the transformer is connected to the others of the connection terminals.

2. The heating system according to claim 1, wherein the ones of the connection terminals are arranged in a row and connected to each other by a bus bar.

* * * * *